United States Patent [19]

Hope et al.

[11] 4,028,860

[45] June 14, 1977

[54] WALL CONSTRUCTION

[76] Inventors: Henry F. Hope; Stephen F. Hope, both of 2548 Wyandotte Road, Willow Grove, Pa. 19090

[22] Filed: Jan. 15, 1976

[21] Appl. No.: 649,224

[52] U.S. Cl. ..... 52/565; 52/411; 52/424; 52/567

[51] Int. Cl.[2] ..... E04B 1/02

[58] Field of Search ..... 52/411, 424, 561, 562, 52/563, 564, 565, 566, 567, 568, 569, 574

[56] References Cited

UNITED STATES PATENTS

| | | | |
|---|---|---|---|
| 1,307,779 | 6/1919 | Johnson | 52/439 |
| 1,451,340 | 4/1923 | Kroonen | 52/567 |
| 1,571,285 | 2/1926 | McDougall | 52/566 |
| 2,892,338 | 6/1959 | Cravens | 52/566 |

*Primary Examiner*—J. Karl Bell
*Attorney, Agent, or Firm*—Z. T. Wobensmith, 2nd; Z. T. Wobensmith, III

[57] ABSTRACT

A masonry wall construction having good heat insulating qualities and strength is disclosed of courses of conventional blocks laid in with mortar, the blocks having interior air spaces, one course having outer blocks of one size and inner blocks of another size spaced to provide an air space and the next course above or below the one course having outer blocks of said other size and inner blocks of said one size spaced to provide an air space, the blocks of the next course being in overlapped relation along the wall and from front to back, intervening horizontal screens filled with mortar being provided at predetermined locations to confine the air within the spaces in the blocks and in the wall.

5 Claims, 3 Drawing Figures

WALL CONSTRUCTION

BACKGROUND OF THE INVENTION

1. Field of the Invention

This invention relates to masonry wall construction capable of being assembled with mortar from available building blocks.

2. Description of the Prior Art

It has heretofore been proposed to build walls of cinder blocks in single courses.

It has also been proposed to build veneer wall systems in which a wall of concrete blocks or cinder blocks has an exterior brick veneer applied in contact therewith and bonded thereto at vertical intervals.

It has also been proposed to provide a cavity wall system comprising an inner wall of cinder or concrete blocks with an outer wall of brick spaced from the inner wall to provide an air space.

In such walls having blocks with interior spaces it has been proposed, in order to reduce the heat transfer therethrough, to fill the spaces with a mineral fill such as perlite, treated or untreated. This is only a partial solution and is not particularly effective.

The structures heretofore available had various shortcomings. The veneer wall systems had higher heat transfer than desired. The cavity wall systems lacked strength because of the separated nature of the spaced blocks and bricks. The air circulation in the cavity wall systems is not conducive to good insulating qualities.

SUMMARY OF THE INVENTION

In accordance with the invention an inexpensive masonry wall construction is provided having good heat insulating qualities and which is constructed of conventional and readily available blocks such as cinder or concrete blocks with air spaces therein, the blocks preferably being of two sizes, one course having the larger blocks on the outside and the smaller blocks on the inside and separated from the outside blocks to promote an air space, the next courses above and below having the larger blocks on the inside and the smaller blocks on the outside, separated as before to provide an air space, the larger blocks of these courses being in overlapped relation longitudinally and from back to front, a barrier of mesh with mortar applied thereto preferably being provided at selected levels to reduce the interior air circulation and enhance the insulating action.

It is the principal object of the invention to provide a masonry wall construction of inexpensive components, which is simple and inexpensive to erect and which will have improved insulating qualities.

It is a further object of the invention to provide a masonry wall construction of the character aforesaid which has great strength.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 1:
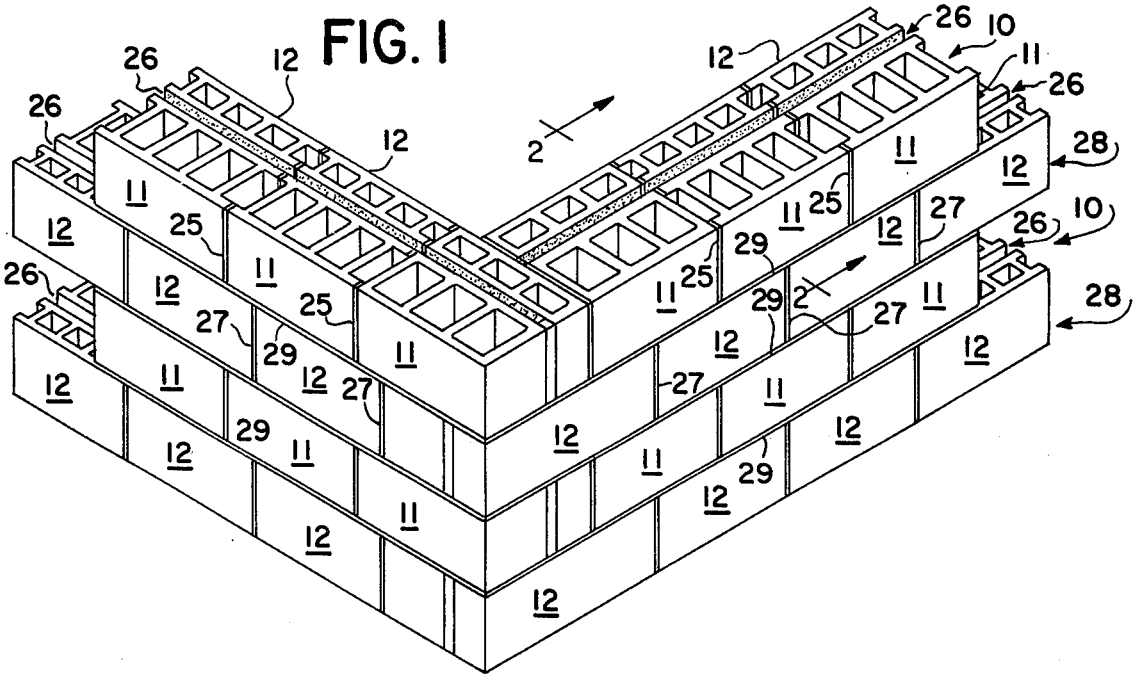
FIG. 1 is a view in perspective of a portion of a wall construction in accordance with the invention.

It should, of course, be understood that the description and drawings herein are illustrative merely and that various modifications and changes can be made in the structure disclosed without departing from the spirit of the invention.

DESCRIPTION OF A PREFERRED EMBODIMENT

Referring now more particularly to the drawings, the masonry wall construction in accordance with the invention preferably includes a plurality of vertically disposed successive horizontal courses, preferably alternating as hereinafter explained.

One course, shown at 10, is preferably composed of two sizes of blocks 11 and 12. The blocks 11, preferably hollow rectilinear cinder blocks, have opposite side faces 13, opposite top and bottom faces 14, end faces 15 with cut-outs 16 to provide air spaces, and interior air spaces 17 to decrease the weight. The blocks 11 in a specific embodiment, can be of a size known as eight inch blocks.

The blocks 12, also preferably hollow rectilinear cinder blocks, have opposite side faces 20, opposite top and bottom faces 21, end faces 22 with cut-outs 23 to provide air spaces and interior air spaces 24 to decrease the weight. The blocks 12, in the same specific embodiment can be of a size known as four inch blocks.

The course 10 has a plurality of blocks 11 disposed with their opposite side faces 13 in the same inner and outer vertical planes and with vertical mortar joints 25 between their meeting end faces 15. Spaced from the blocks 11, with a space 26 which may in the specific embodiment referred to, be about one inch, the blocks 12 are laid with their opposite side faces 20 in the same inner and outer vertical planes and with mortar joints 27 between their meeting end faces 22. The end faces 22 can be in the same planes as the end faces 15 although if desired they could be offset half the horizontal lengths of the blocks 11.

The next course 28, above the courses 10, is, like the course previously described, composed of blocks 11 and 12, but differently and oppositely located insofar as the outer face of the wall is concerned. The blocks of the courses 10 and 28 have horizontal mortar joints 29 therebetween. The blocks 11 of the course 28 provide the opposite face of the wall from the blocks 11 of the course 10 and have their side faces 13 in spaced vertical planes and preferably, longitudinally considered, overlap the blocks 12 of the course 10 by half the length of the blocks 12. These blocks 11, also, transversely considered, overlap the blocks 12 of the course 10 and have vertical mortar joints 25 between end faces 15.

The course 28 also has blocks 12 spaced from blocks 11 by vertical air spaces 26, positioned over the blocks 11 of the course 10 and with vertical mortar joints 27 therebetween. The course 10 and 28 are alternated to complete the wall.

Figure 2:
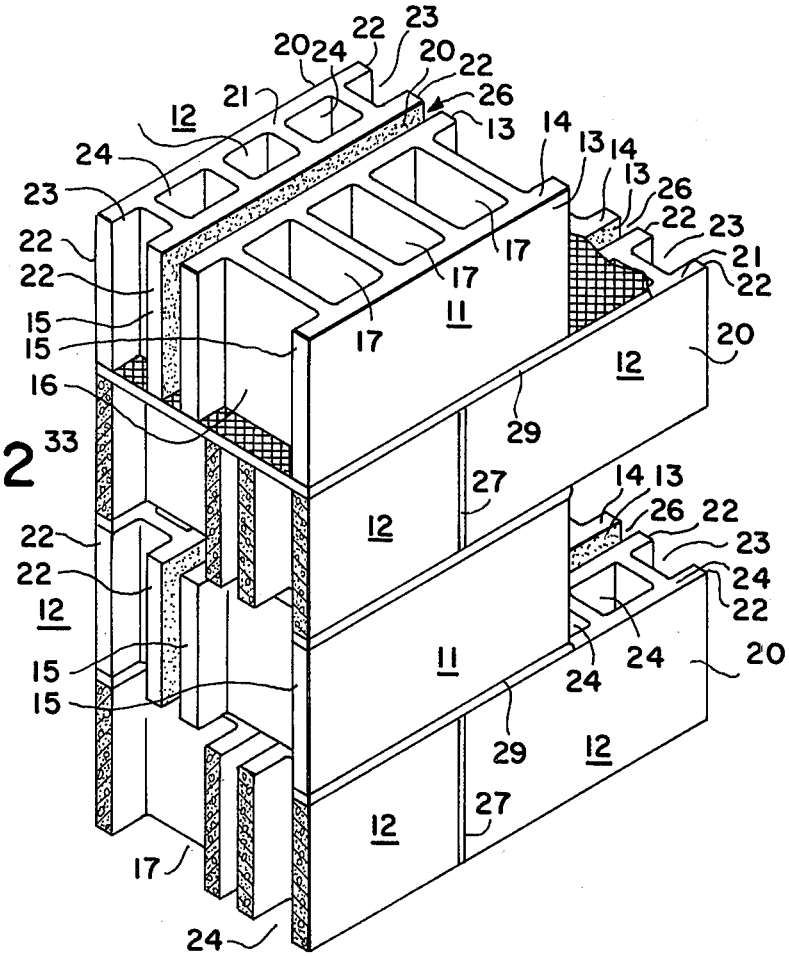
FIG. 2 is a fragmentary vertical sectional view taken approximately on the line 2—2 of FIG. 1.
Figure 3:
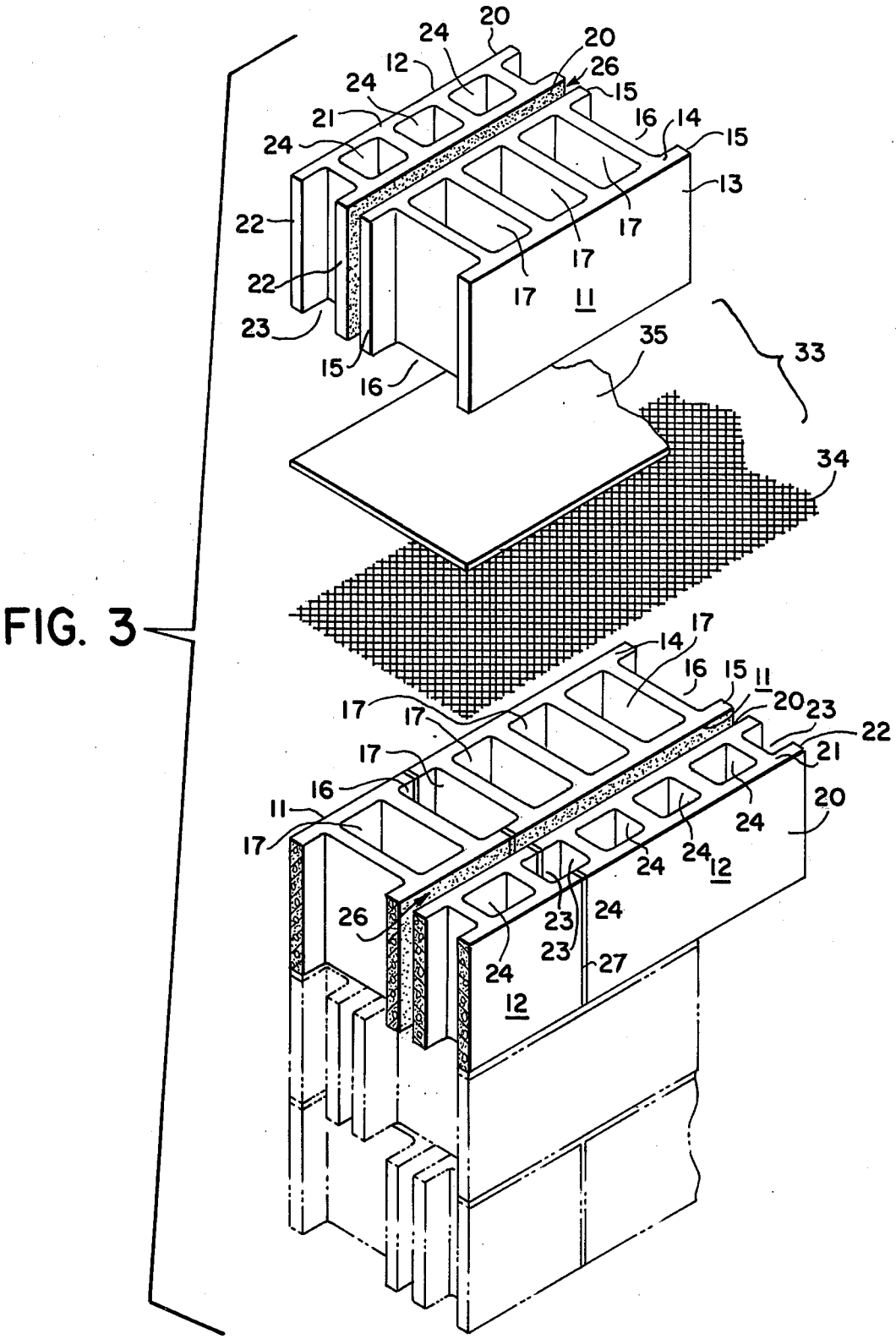
FIG. 3 is an exploded perspective view of the portion of wall illustrated in FIG. 2 and showing the details of construction.

As can be seen in FIG. 2 the vertical ribs bounding the interior respective air spaces 17 and 24, when the blocks are laid up, are offset out of contact with each other thereby reducing heat transfer from one vertical face of the wall to the other. At predetermined horizontal locations between courses 10 and 28, and preferably at every third horizontal joint 29, an air barrier 33 is provided which may consist of a wire mesh layer 34 extending from front to back and lengthwise, onto which a thin covering layer of mortar 35 is applied. The barrier 33 limits the vertical distance available for air circulation within the interior air spaces 17, 24 and 26 and at the end cut-outs 16 and 23 and thus increases the insulating effect of the interiorly trapped air.

The inner and outer faces of the wall can be finished, if desired, in any suitable manner such as by painting, or the application of plaster or other surface coatings or interiorly by the application of paneling as heretofore proposed for masonry walls.

We claim:

1. A masonry wall construction comprising a plurality of successive vertically disposed horizontal courses of masonry blocks, one of said horizontal courses having on the exterior thereof in succession a plurality of first hollow rectilinear blocks of a predetermined size with flat faces on the top and bottom thereof and vertical interior openings connecting said flat faces and with vertical mortar joints between the ends of said first blocks, said first blocks having vertical ribs bounding said interior openings, said first blocks having their outer exposed side faces in a vertical outer wall plane, said one horizontal course having in succession a plurality of second rectilinear blocks of a small predetermined size spaced from the first blocks with flat faces on the top and bottom thereof and vertical interior openings connecting said flat spaces and with vertical mortar joints between the ends of said second blocks, said second blocks having vertical ribs bounding said interior openings, said second blocks having their exposed side faces in a vertical inner wall plane spaced from the outer wall plane, the next succeeding horizontal course having on the interior thereof in succession a plurality of said first blocks with vertical mortar joints between the ends thereof and in transversely overlapping relation to the first blocks of said one course and with their exposed faces in the vertical outer wall plane, said succeeding horizontal course having in succession a plurality of second blocks with vertical mortar joints between the ends thereof spaced from said first blocks of said succeeding course and with their exposed side faces in the vertical inner wall plane, the ribs of blocks of successive horizontal courses being offset and out of contact with each other.

2. A masonry wall construction as defined in claim 1 in which the second blocks in said succeeding course are in longitudinal overlapping relation to the first blocks in said one course.

3. A masonry wall construction as defined in claim 1 in which said first and second blocks have end faces in transverse alignment in at least one of said courses.

4. A masonry wall construction as defined in claim 1 in which an interiorly disposed horizontal air barrier is provided at a horizontal mortar joint between courses for closing vertical access to spaces between and in said blocks.

5. A masonry wall construction as defined in claim 4 in which said air barrier comprises a wire mesh layer with a covering layer of mortar.

* * * * *